United States Patent [19]

Benson

[11] 4,309,850

[45] Jan. 12, 1982

[54] SANDBLASTING MACHINE

[76] Inventor: Ronald C. Benson, 2116 Second Ave. South, Minneapolis, Minn. 55404

[21] Appl. No.: 65,985

[22] Filed: Aug. 9, 1979

[51] Int. Cl.[3] ..... B24C 3/06

[52] U.S. Cl. ..... 51/429

[58] Field of Search ..... 51/410, 427, 429; 118/315; 239/243

[56] References Cited

U.S. PATENT DOCUMENTS

| | | | |
|---|---|---|---|
| 1,864,612 | 6/1932 | Pearson | 51/429 X |
| 2,684,558 | 7/1954 | Harris | 51/429 X |
| 2,729,918 | 1/1956 | Van Denburgh | 51/429 |
| 2,836,013 | 5/1958 | Koenig | 51/427 |
| 3,075,319 | 1/1963 | Blubaugh | 51/429 |
| 3,391,701 | 7/1968 | Richardson | 239/243 X |
| 4,019,284 | 4/1977 | Hileman | 51/429 |
| 4,036,437 | 7/1977 | Dreher | 51/429 X |
| 4,149,345 | 4/1979 | Atsuchi | 51/429 X |

*Primary Examiner*—Nicholas P. Godici

*Attorney, Agent, or Firm*—Michael E. Kiteck, Jr.

[57] ABSTRACT

A portable sandblasting apparatus for continuously treating horizontal surfaces along a path of adjustable width. The apparatus is mounted on a movable platform which is drawn by a motor vehicle or self-propelled along the desired path. The apparatus has sandblast nozzles which reciprocate from side to side with respect to the direction of motion as the apparatus advances so as to provide treatment of a pre-set width of surface. By adjusting the amplitude of reciprocation, positioning the nozzles for continuous coverage and by varying the number of nozzles functioning, the width of surface to be treated may be varied greatly and readily adjusted.

6 Claims, 15 Drawing Figures

16
18
17
190
10
22
24
26
22
19
14
20
12

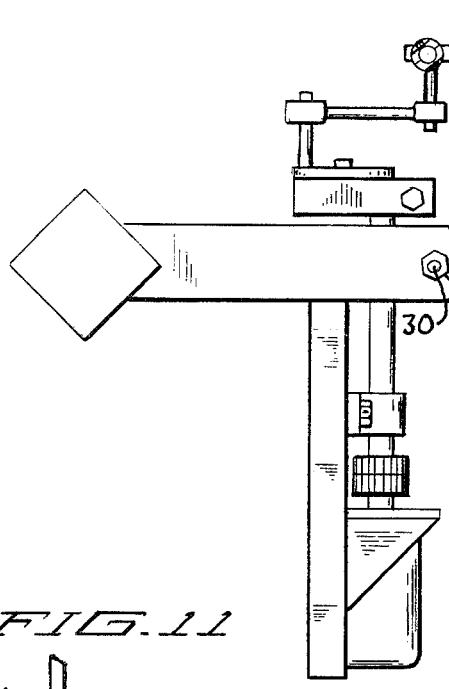
FIG. 9
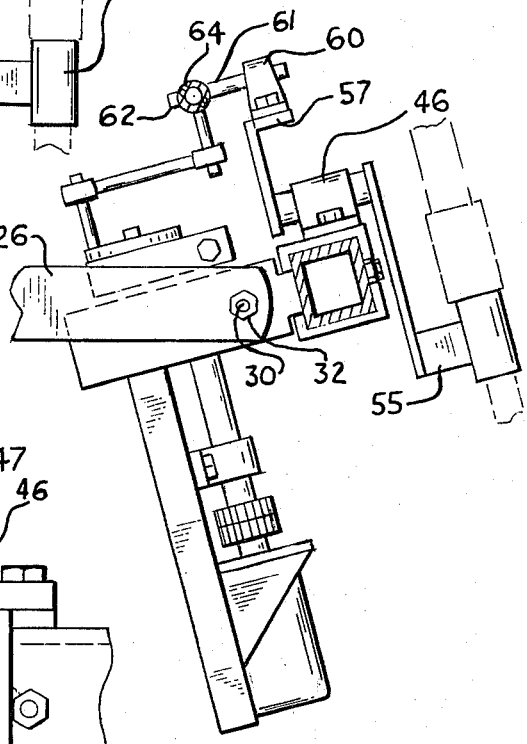
FIG. 10
FIG. 11
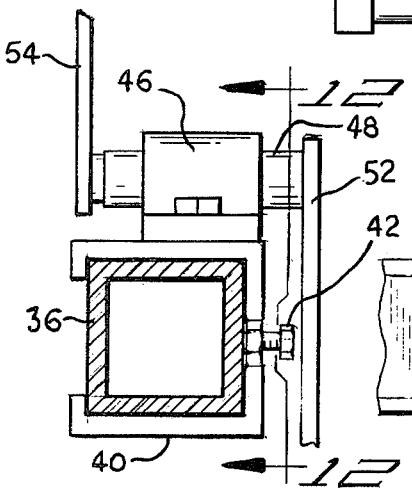
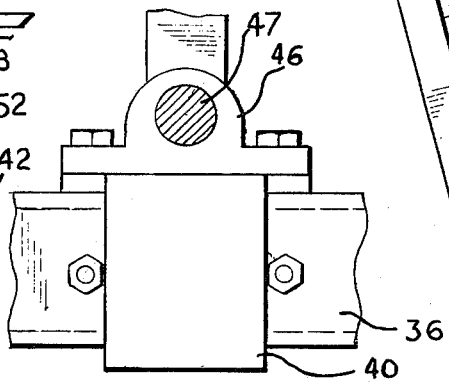
FIG. 12
FIG. 13
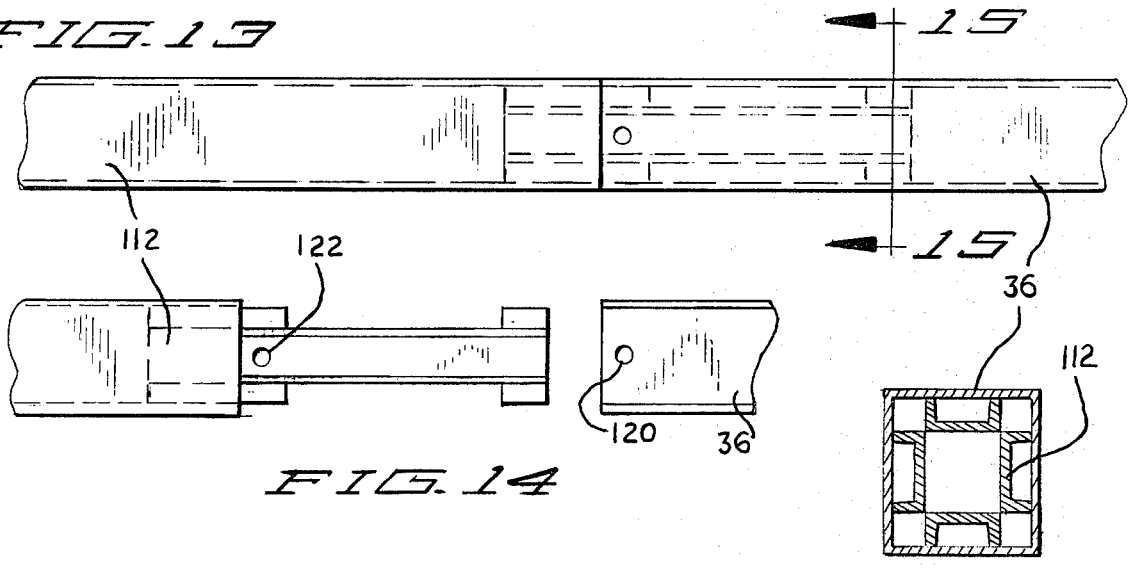
FIG. 14
FIG. 15

SANDBLASTING MACHINE

BACKGROUND OF THE INVENTION

This invention relates to a portable apparatus for surface treatment by sandblasting in order to remove dirt, loose particles of the surface and rust. More particularly, it relates to a portable surface treating apparatus provided with an improved means of positioning and oscillating at least one nozzle so as to treat a pre-set width of surface. More particularly such surface treatment is effective for cleaning vehicular surfaces such as highway, airport runway or bridge deck surfaces when these are newly made, when these have been traveled and after broken and crumbling portions have been removed by air hammers or chisels or other means, so as to promote good bonding of coating, patching or overlaid material.

In U.S. Pat. No. 1,889,132, description is made of a multiple blast nozzle which could be used for cleaning a swath of surface if mounted on a movable platform.

The array of nozzles of the above referenced patent is restricted to the blast pattern produced by the array and may not be adjusted as to width. This is not satisfactory where it is desirable to clean various widths of surface such as roadway or highway lanes.

In U.S. Pat. No. 4,126,970, description is made of an abrasive cleaning apparatus with a nozzle holder which moves a plurality of nozzles as a unit. This array does not automatically oscillate but is under operator control. It is necessary to provide an operator which is a distinct disadvantage in terms of cost of operation and the work environment proximate to the sandblasting operation.

Accordingly, it is an object of the present invention to provide a mobile surface treating apparatus capable of complete and even coverage of a swath of road surface.

It is another object of the invention to provide a mobile surface treating apparatus capable of being adjusted quickly and easily to a given width.

It is still another object of the invention to provide a mobile surface treating apparatus capable of being adjusted over a great range of widths of surface to be treated in one swath.

It is yet another object of the present invention to provide a mobile surface treating apparatus capable of starting a swath from a wall, obstacle or other point with a beginning perpendicular to the direction of travel and all the way to said wall, obstacle or other point so as to eliminate or lessen the need for handwork.

It is a further object of the present invention to provide a mobile surface treating apparatus capable of reciprocating nozzles in gang fashion about pivot points which may be moved when setting up so as to vary the width of swept surface easily and accurately.

It is a yet further object of the present invention to provide a mobile surface treating apparatus capable of reciprocating nozzles in gang fashion by extendible means and upon pivot points upon an extendible support member so as to permit the ganging of additional nozzles so as to allow adjustment of width of treated surface to a greater width than possible without the addition of said additional nozzles.

It is still a further object of the invention to provide a mobile surface treating apparatus capable of operator control so as to turn off individual nozzles to permit operation with fewer nozzles or one nozzle so the width of treated surface is diminished to a desired narrow width without any change to the nozzle array, movable platform, or reciprocating means.

Other U.S. Pat. Nos. considered during the preparation of this application, but not believed pertinent to the present invention, are: 3,110,234 Oster, 3,432,969 Byttebier, 3,691,689 Goff, 3,934,373 Leliaert, 3,977,128 Goff, 4,019,284 Hileman.

BRIEF DESCRIPTION OF THE DRAWINGS

FIG. 9 is a partial side view of the portion of the reciprocating mechanism shown in FIG. 5.

FIG. 10 is a partial side view of the members in FIG. 9 showing the base and reciprocating mechanism adjusted to position the nozzles at an angle to the vertical.

FIG. 11 is an enlarged cross section on the line 11—11 of FIG. 6.

FIG. 12 is a cross section on the line 12—12 of FIG. 11.

FIG. 13 is an enlarged rear view of the extended supporting base shown in FIG. 4, and having portions cut away to show internal parts.

FIG. 14 is an enlarged rear view of the extended supporting base shown in FIG. 13 showing the parts partially disassembled.

FIG. 15 is a cross section on the line 15—15 of FIG. 13.

DESCRIPTION OF THE PREFERRED EMBODIMENT

Figure 1:
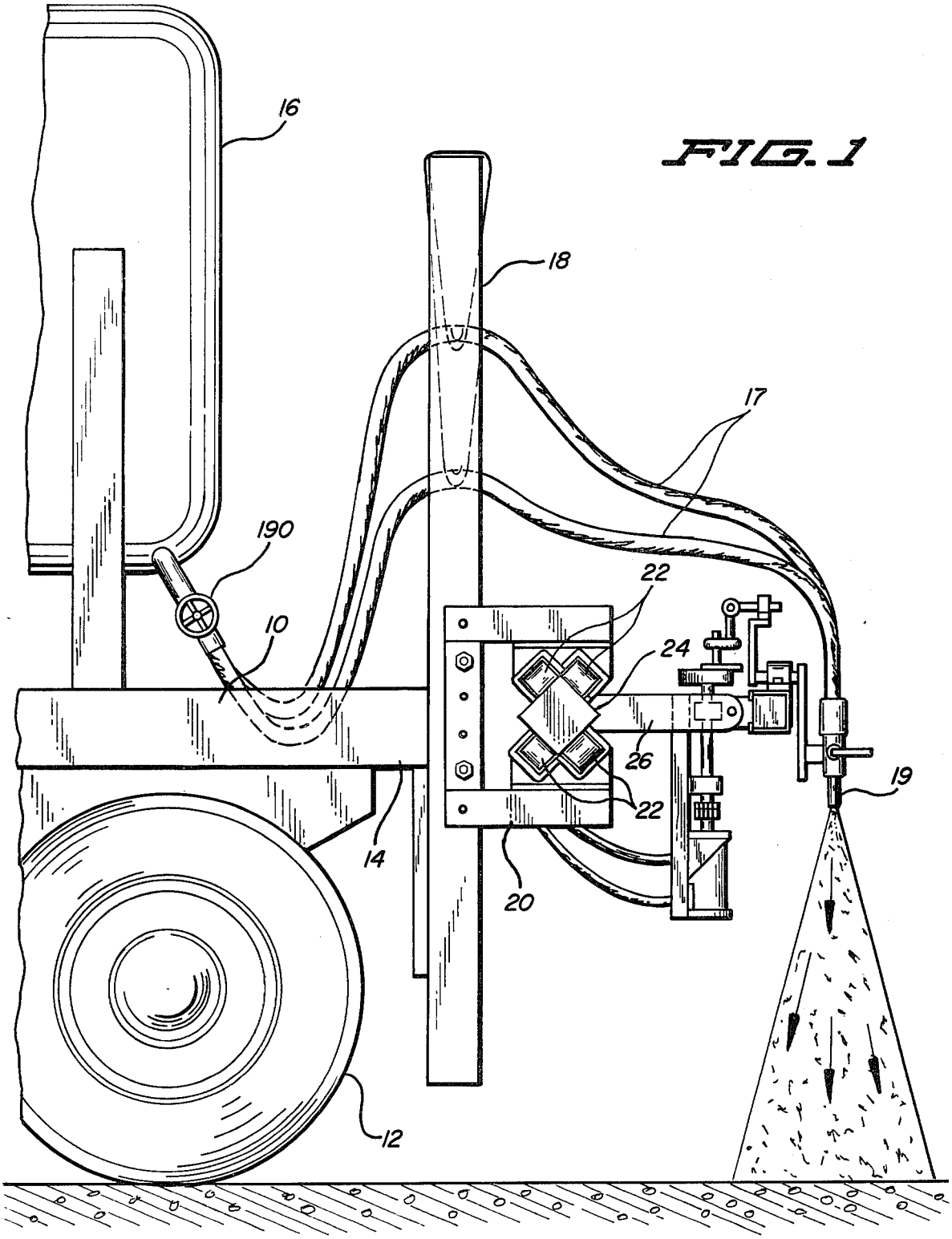
FIG. 1 is a partial side view of a preferred form of surface treating apparatus of this invention mounted at the rear of a wheeled frame or vehicle.
Figure 2:
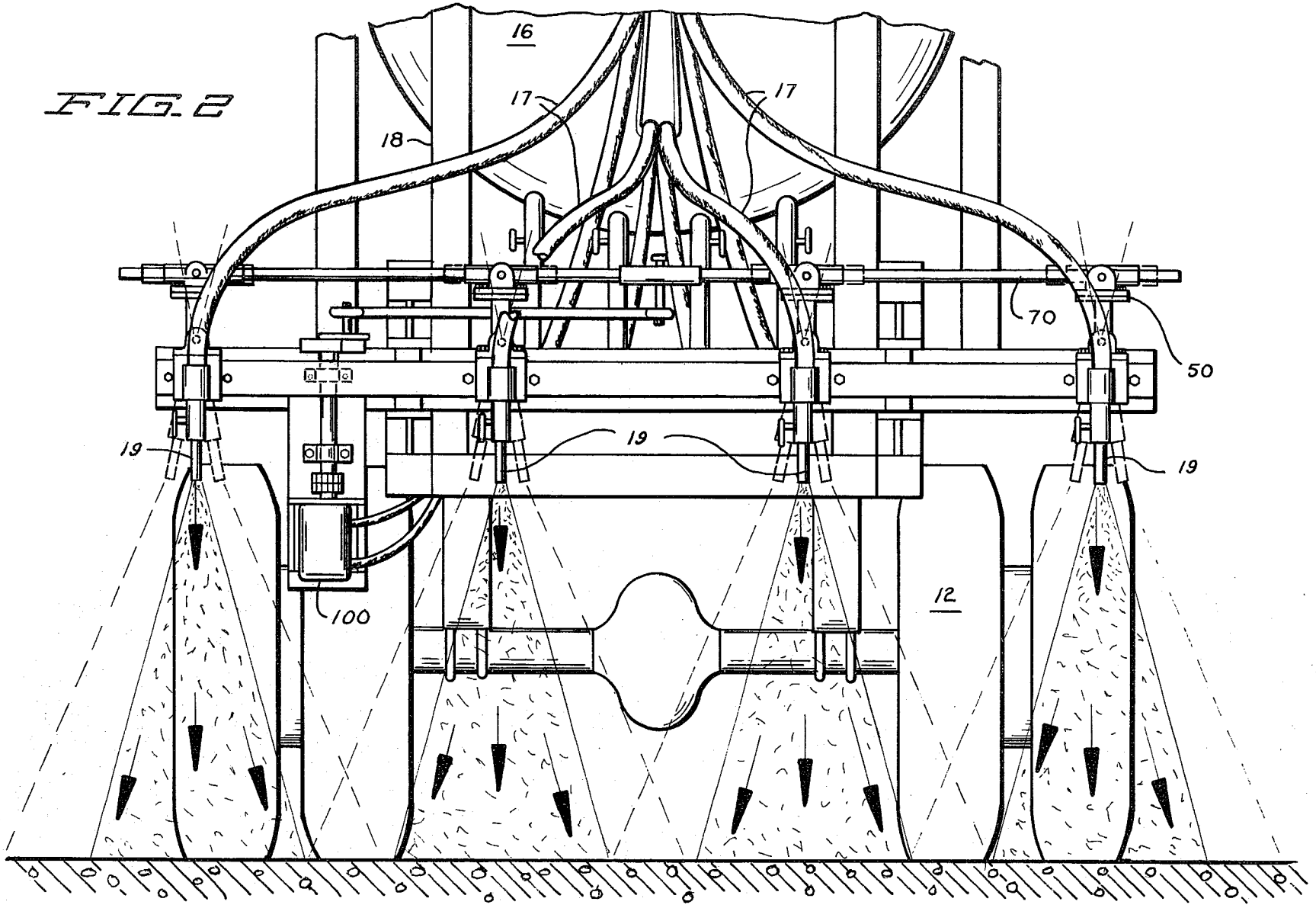
FIG. 2 is a rear elevational view of a surface cleaning apparatus of this invention.

Referring to FIGS. 1 and 2, a preferred embodiment of the invention is shown therein. The sandblasting apparatus is mounted on a trailer frame 10 having wheels 12 attached to the rear end 14 thereof. Alternatively the present invention is mounted upon a self-propelled vehicle. Mounted upon the trailer frame 10 is a source 16 of pressurized sand and air mixture, which is partially shown as is the trailer frame, both being commonly known. Connecting to the source of pressurized sand and air mixture by means of a valve 190 are hoses 17 for conveying the sand and air mixture to sandblasting nozzles 19, which discharge the pressurized sand and air mixture at high velocity.

Mounted to the rear end 14 of the trailer frame 10 is a vertically disposed subframe 18. At either side of this subframe 18 are mounted support assemblies 20. The support assemblies each contain rollers 22 positioned so as to support and guide a member 24 of square cross section which is slidably positioned by the rollers so that it may be moved from side to side.

Figure 3:
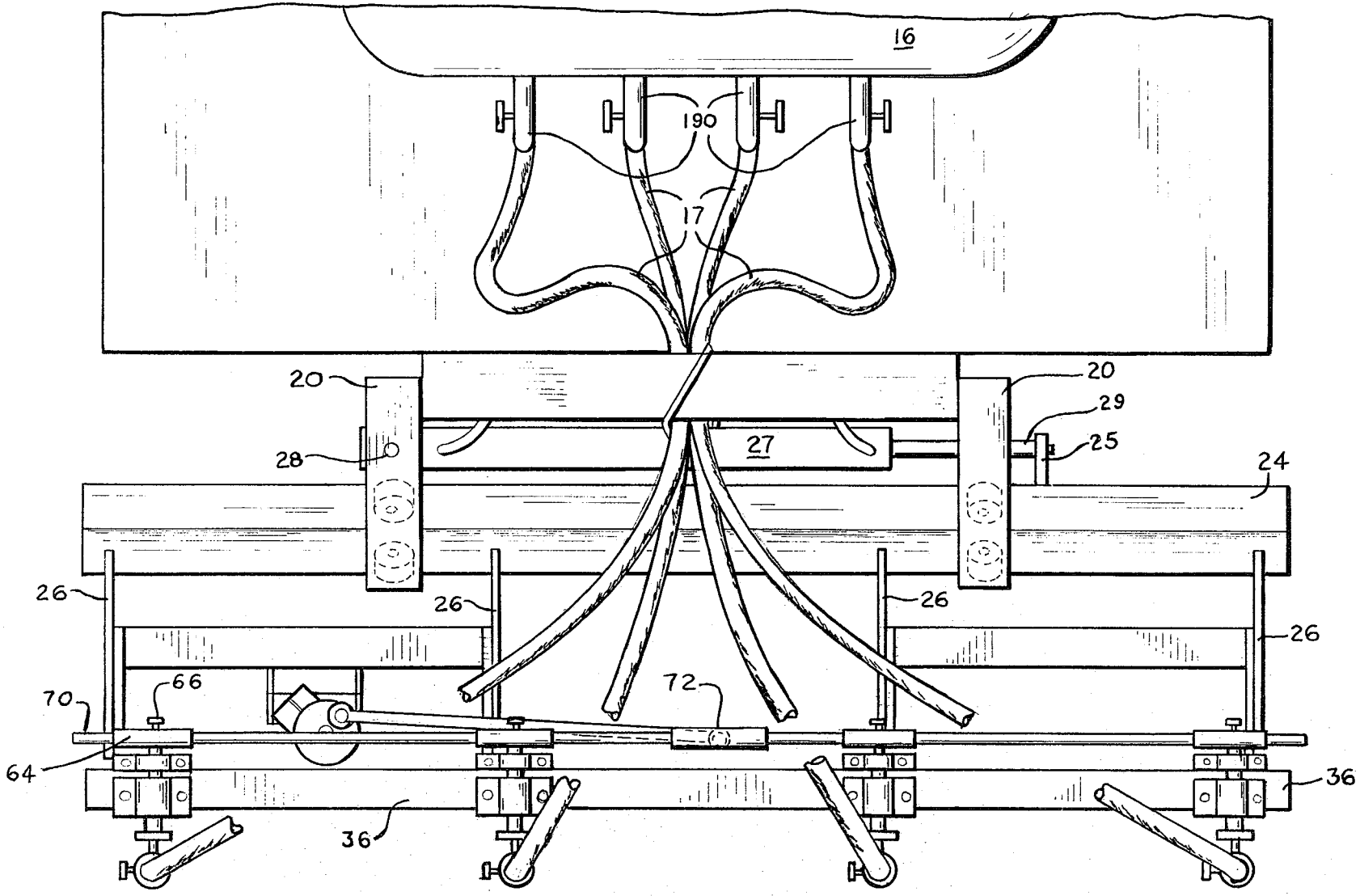
FIG. 3 is a partial top view of the apparatus of FIG. 1 with the top portion of the metal frame removed to more clearly show the oscillating mechanism.

Referring to FIG. 3, the member 24 of square cross section is positioned in the desired location by means of a double acting hydraulic cylinder 27 (FIG. 3) attached at one end by pivotal means 28 to one of the support assemblies 20. The extendible shaft 29 extending from the other end of the hydraulic cylinder is attached to a lug 25 affixed to the member 24 of square cross section so the member is moved to one side as the hydraulic cylinder 27 is extended and to the other as the hydraulic cylinder is retracted.

Shown attached to the member 24 are a plurality of flat support members 26 (FIG. 3) extending backward away from the trailer frame 10, and which flat support members 26 have holes through the rearwardmost portion. A plurality of bolts 30 (FIG. 9, FIG. 10) pass through these holes to meet corresponding nuts 32 (FIG. 9, FIG. 10). These nuts 32 and bolts 30 secure a supporting base 36 which is attached to the support members 26 by the bolts 30 and nuts 32. This supporting base 36 may rotate about the axis of the plurality of bolts 30, which rotation may be prevented by tightening the nuts 32 upon the bolts 30 resulting in friction between that portion of the supporting base 36 and the support members 26 clamped together by the nuts 32 and bolts 30.

Slidably situated upon the supporting base 36 are a plurality of mounts 40 (FIG. 3 and FIG. 11) affixed at desired locations upon the supporting base 36 by bolts 42 (FIG. 11) threaded through the mount so that when tightened they contact the supporting base 36 and lock the mounts 40 in position.

In FIG. 11 a mount is shown in cross section affixed by bolt 42 to the supporting base 36. Upon the mount is secured a pillow block 46. The shaft 47 of the pillow block 46 serves as an offset and pivot for a lever 50 formed of a lower arm 52 and an upper arm 54 connected by the shaft 47. In the present embodiment the lower arm 52 is secured to the rearward end 48 (FIG. 12) of the shaft 47 of the pillow block 46. This lower arm 52 terminates in means for mounting a sandblast nozzle such as an offset spacer 55 (FIG. 9) to which is affixed a receptacle 56 suited for receiving a sandblast nozzle 19. The upper arm 54 is secured to the forward end 51 of the shaft 47 which is disposed 180 degrees to the lower arm 52. The upper arm 54 terminates in an offset 57 upon which is secured a small pillow block 60 (FIG. 9). The shaft 61 of the small pillow block 60 is attached at its forward end 62 to a sleeve 64. This sleeve 64 fits over a rod 70 to which it is secured by a bolt 66 (FIG. 3).

Each of the plurality of mounts 40 supports a lever 50 arranged and connected as described above. The mounts 40 are secured at the desired locations on the supporting base 36 and the sleeve 64 of each is secured by a bolt 66 over the rod 70 and adjusted so that all of the levers are parallel one to the other.

Figure 5:
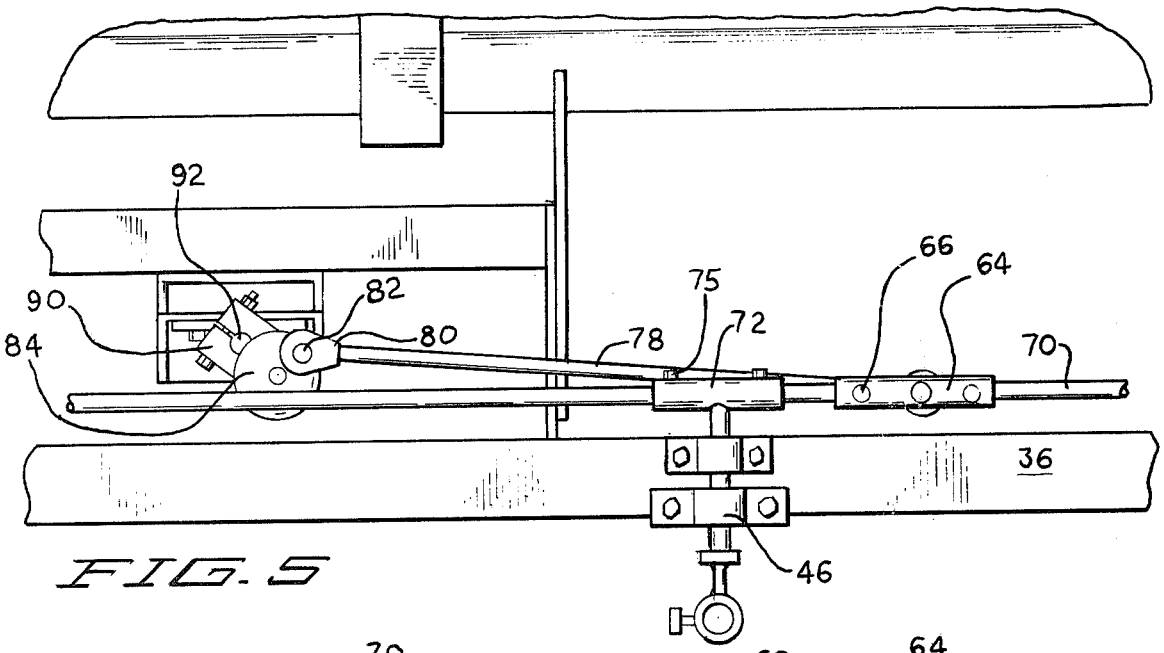
FIG. 5 is a detail partial top view of that portion of the oscillating mechanism of this invention comprising the drive means.
Figure 6:
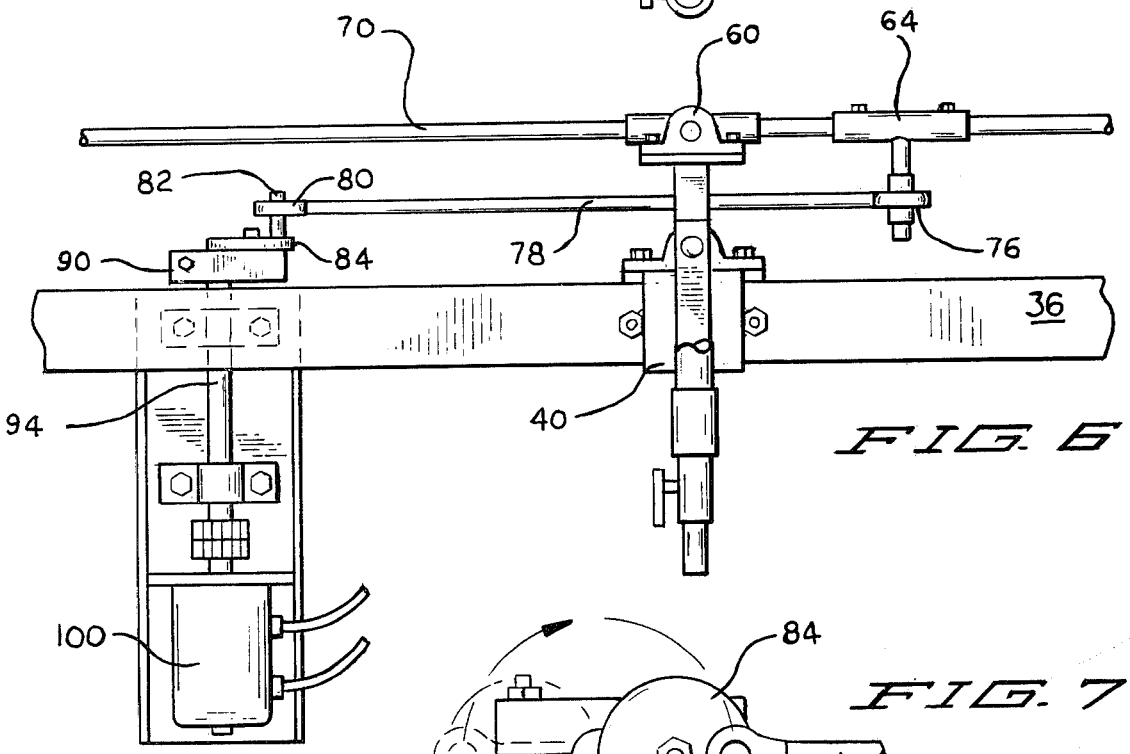
FIG. 6 is a detail partial rear elevation of the same parts shown in FIG. 5.
Figure 7:
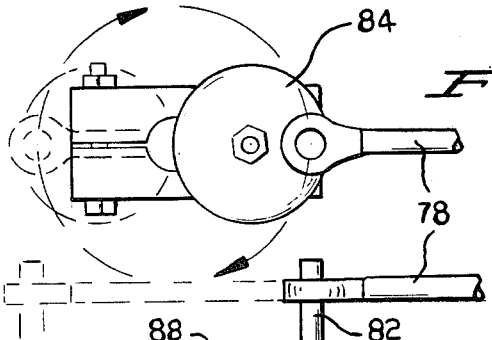
FIG. 7 is a partial top view of the reciprocating mechanism of FIG. 5 showing the adjustable rotating member and and connected parts.
Figure 8:
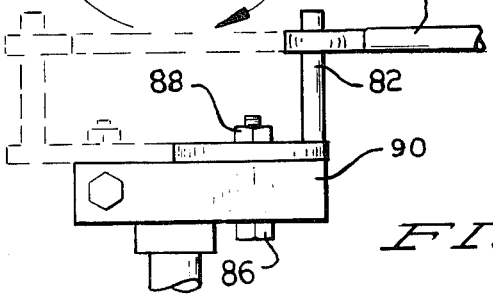
FIG. 8 is a partial rear elevational view of the parts shown in FIG. 7.

Also attached about the rod 70 is a sleeve 72 (FIG. 5, FIG. 6) affixed to the rod 70 by bolts 74, 75. Secured to this sleeve 72 is a pivotal coupling 76. This pivotal coupling 76 is attached to a connecting rod 78 which connects to a bearing 80. The shaft 82 of this bearing 80 is affixed to adjusting means such as a metal disc 84 (FIG. 7) which disc is clamped by a bolt 86 and nut 88 (FIG. 8) to a rotatable crank member 90. The rotatable crank member 90 is secured to the end 92 of a shaft 94 which terminates at a hydraulic motor 100. When the hydraulic motor 100 turns the shaft 94, the rotatable crank member 90 rotates and causes the attached connecting rod 78 to move in an oscillating fashion. The amplitude of the oscillating motion may be adjusted by turning the disc 84 clamped to the rotatable crank member 90 so as to change the distance from the shaft 82 of the bearing 80 at the end of the connecting rod 78 to the shaft 94 extending to the hydraulic motor 100. The reciprocating motion of the connecting rod 78 is transmitted through the bearing 76 to the sleeve 72 which in turn causes the rod 70 to oscillate. The reciprocating motion of the rod 70 in turn is transmitted to the lever arms 52, 54 to which are attached the receptacles 56 for receiving sandblasting nozzles 19. In turn the receptacles 56 and sandblasting nozzles 19 move from side to side in an oscillating motion. The amplitude of the motion of the nozzles 19 is proportional to that of the connecting rod 78 so that the adjustment of the disc 84 varies the amplitude of oscillating motion of the nozzles 19. The mounts 40 which are slidably situated on the subframe 36 may be moved on the subframe 36 and the sleeves 64 on the rod 70 so that the lever arms 52, 54 are located in suitable positions along the subframe 36. The lever arms 52, 54 determine the center of motion of each sandblast nozzle 19. Normally the nozzles 19 are positioned at equal intervals along the subframe 36. The amplitude of oscillating motion may then be adjusted to provide a small overlap of sandblast patterns from adjacent nozzles 19 so that the surface treatment is continuous over the full width selected.

Figure 4:
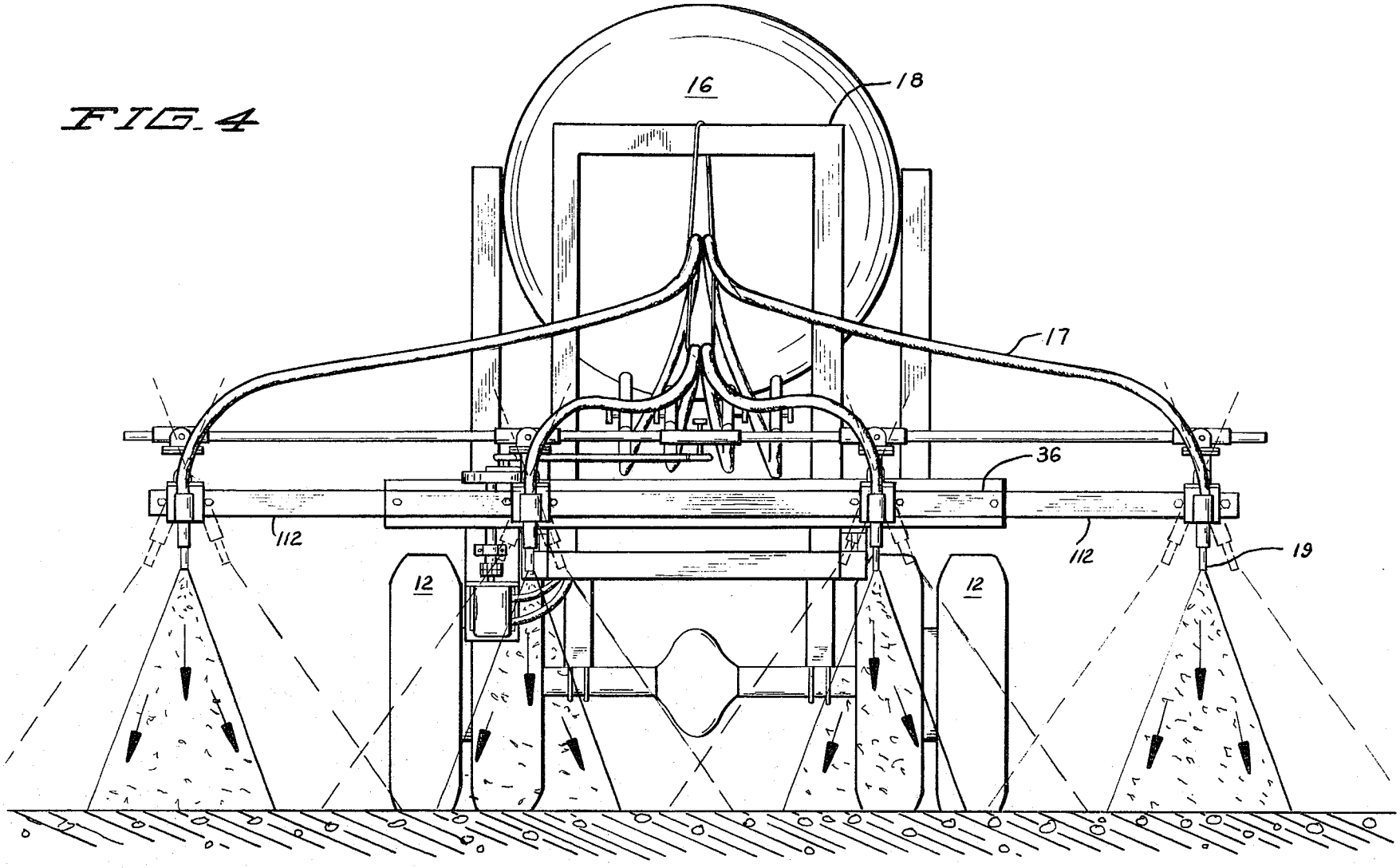
FIG. 4 is a rear elevational view of a surface cleaning apparatus of this invention with an extended supporting base and extended reciprocating mechanism allowing the oscillating nozzles to be more widely displaced from the centerline of the apparatus.

FIG. 4 shows the apparatus with supporting base extensions 112 mounted on the supporting base 36 so as to allow wider separation of the nozzles 19 for treating a wider surface than would otherwise be possible.

FIG. 13 is a detail of how the supporting base extension 112 is fitted to the supporting base 36.

FIG. 14 is a detail of the same after disassembly. Supporting base 36 is provided with a hole 120 and supporting base extension 112 with a matching hole 122 so that when the extension 112 is fitted to the supporting base 36, the holes are in alignment and may be thusly secured with a bolt and nut (not shown).

When the apparatus is set up as shown in FIG. 4 the sandblast nozzles 19 are connected to the source 16 of high pressure sand and air mixture by hoses 17. When the valves 19 on the hoses 17 are opened, the high pressure sand and air mixture travels inside the hoses 17 and exits the sandblast nozzles 19, which are put in oscillating motion as described above to treat the width of surface set by the operator.

While I have shown and described an embodiment of this invention in some detail, it will be understood that this description and illustrations are offered merely by way of example, and that the invention is to be limited in scope only by the appended claims.

Having disclosed and described a preferred embodiment of the invention, what I claim to be new and desire to protect by United States Letters Patent is:

1. A mobile apparatus for sandblasting a roadway surface over which it is moving, having a frame supporting a source of pressurized sand and air mixture, a plurality of transversely spaced nozzles connected with said source and directed downwardly to sandblast a path on the roadway surface as the apparatus moves thereon, and means for adjustably mounting the nozzles on the frame which comprises:

(a) a base, (b) a plurality of parallel levers each of which is connected pivotally to the base, (c) means for mounting the nozzles to the levers so the nozzles may move with the levers in an oscillating fashion with respect to the base, and (d) means for oscillating the levers with respect to the base, wherein the means for oscillating the nozzles with respect to the base further comprises a rod pivotally connecting the levers, and means for moving the rod in an oscillating fashion from side to side with respect to the direction the apparatus is moving over the surface, wherein the means for moving the rod is a crank member connected to the rod so as to impart an oscillating motion to the rod when the crank member is rotated, which further comprises means for slidably adjusting the position of each of the levers to any point along the base so the spacing of the nozzles may be varied.

2. A mobile apparatus for sandblasting a roadway surface over which it is moving, having a frame supporting a source of pressurized sand and air mixture, a plurality of transversely spaced nozzles connected with said source and directed downwardly to sandblast a path on the roadway surface as the apparatus moves thereon, and means for adjustably mounting the nozzles on the frame which comprises:

(a) a base, (b) a plurality of parallel levers each of which is connected pivotally to the base, (c) means for mounting the nozzles to the levers so the nozzles may move with the levers in an oscillating fashion with respect to the base, and (d) means for oscillating the levers with respect to the base, which further comprises means for slidably adjusting the position of each of the levers to any point along the base so the spacing of the nozzles may be varied.

3. The apparatus of claim 2 wherein the means for oscillating the nozzles with respect to the base further comprises:

a rod pivotally connecting the levers, and a crank member connected to the rod so as to impart an oscillating motion to the rod when the crank member is rotated.

4. The apparatus according to claim 3 wherein the pivotal connection of the plurality of levers to the base restricts motion of the levers to a vertical plane transverse to the direction of motion of the apparatus.

5. A mobile apparatus for sandblasting a roadway surface over which it is moving, having a frame supporting a source of pressurized sand and air mixture, a plurality of transversely spaced nozzles connected with said source and directed downwardly to sandblast a path on the roadway surface as the apparatus moves thereon, and means for adjustably mounting the nozzles on the frame which comprises:

(a) a base, (b) a plurality of parallel levers each of which is connected pivotally to the base, (c) means for mounting the nozzles to the levers so the nozzles may move with the levers in an oscillating fashion with respect to the base, and (d) means for oscillating the levers with respect to the base, further comprising means for operator control to selectively turn off one or more nozzles so as to change the width of the path being treated.

6. In an apparatus for sandblasting a surface over which it is moving, having a mobile frame supporting a source of pressurized sand and air mixture, a plurality of transversely spaced nozzles connected with said source and directed downwardly to sandblast a path on the surface as the apparatus moves thereon, and means for adjustably mounting the nozzles on the frame which comprises:

(a) a base, (b) a plurality of parallel levers each of which is connected pivotally to the base, (c) means for mounting the nozzles to the levers so the nozzles may move with the levers in an oscillating fashion with respect to the base, and (d) means for oscillating the levers with respect to the base, which further comprises means for slidably adjusting the position of the levers along the base so the spacing of the nozzles may be varied, wherein the means for oscillating the nozzles with respect to the base further comprises a rod pivotally connecting the levers, and a crank member connected to the rod so as to impart an oscillating motion to the rod when the crank member is rotated, wherein the base further comprises removable base extensions so the spacing of the nozzles may be further varied.

* * * * *